US005548984A

United States Patent [19]

Miyatsu

[11] Patent Number: 5,548,984

[45] Date of Patent: Aug. 27, 1996

[54] LOCKING/UNLOCKING STATE CONFIRMING DEVICE

[76] Inventor: Takayoshi Miyatsu, 11-4, Aobadai 1-chome, Aoba-ku, Yokohama-city, Kanagawa-ken 227, Japan

[21] Appl. No.: 286,239

[22] Filed: Aug. 8, 1994

[30] Foreign Application Priority Data

Aug. 9, 1993 [JP] Japan ..... 5-214815
Jun. 27, 1994 [JP] Japan ..... 6-165788

[51] Int. Cl.[6] ..... E05B 41/00; E05B 47/00

[52] U.S. Cl. ..... 70/276; 70/432; 70/408; 70/413

[58] Field of Search ..... 70/408, 413, 414, 70/432, 438, 441, 276, 388; 40/330, 634

[56] References Cited

U.S. PATENT DOCUMENTS 3,394,565 7/1968 Turman ..... 70/414
4,908,605 3/1990 Takatsuka ..... 70/432
4,936,896 6/1990 Takatsuka ..... 70/408

FOREIGN PATENT DOCUMENTS 3267483 11/1991 Japan ..... 70/432
438382 2/1992 Japan ..... 70/413
449391 2/1992 Japan ..... 70/432

*Primary Examiner*—Steven N. Meyers
*Assistant Examiner*—Tuyet-Phuong Pham
*Attorney, Agent, or Firm*—Wenderoth, Lind & Ponack

[57] ABSTRACT

A locking/unlocking state confirming device includes a drive magnet formed of at least a pair of permanent magnets and a key provided with a key bow. A magnet holding chamber is formed within the key bow. An indicator magnet within the chamber is magnetized in a direction at a right angle relative to a center axis thereof and has first and second outer peripheral surfaces painted different colors. A viewing window is open to the chamber at at least one side surface of the key bow. A holding plate is disposed within the key bow at a location rearwardly of the magnet holding chamber.

4 Claims, 7 Drawing Sheets

LOCKING/UNLOCKING STATE CONFIRMING DEVICE

BACKGROUND OF THE INVENTION

1. Field of the Invention

This invention relates to a locking/unlocking state confirming device in which the most recent locking/unlocking state of a lock can be indicated on a key so that its user can confirm visually the locking/unlocking state of a house or a car by looking at the key.

2. Description of the Related Art

Many types of so-called locking/unlocking state confirming devices having the above function are proposed at present. One such known locking/unlocking state confirming device is disclosed in Japanese Patent Application No. 145163/1992. Such device is a good idea in that it does not require a battery for indicating the locking/unlocking state.

A construction of such locking/unlocking state confirming device will be briefly described. As shown in FIG. 1, a first drive magnet 5 and a second drive magnet 6, which comprise respective permanent magnets, are secured to a front end face of an outer sleeve 2 of a cylinder lock 1 at locations symmetrical with respect to a key way 4 open to an inner cylinder 3. The first and second drive magnets 5 and 6 are mutually oppositely magnetized in an axial direction of the inner cylinder 3. For example, if the surface of the first drive magnet 5 is an N pole, that of the second drive magnet 6 is an S pole.

A magnet holding chamber 11 is formed in that area within a non-magnetic key bow 8 attached to a key bow portion of a key 7 which is proximate to a front end face opposite to the cylinder lock 1 (see FIG. 2) and which is generally in alignment with the drive magnets in a radial direction of the cylinder lock 1 when a stem 9 of the key 7 is inserted in the key way (see FIG. 3). A suction plate or holding plate 12 of magnetic properties is firmly secured to a front inner surface of the magnet holding chamber 11. A prismatic indicator magnet 13 is magnetically drawn to and held by the holding plate 12.

In general, a lock device comprising a cylinder lock and a key is designed such that when the key 7 (specifically, the stem 9 of the key 7) is inserted into the key way 4 of the cylinder lock and turned, for example, clockwise for locking, the key 7 is required to be turned counterclockwise for unlocking. In this way, the indicator magnet 13 within the key bow of the key which is caused to approach the first magnet 5 for locking is, in turn, caused to approach the remaining second magnet 6, which has a different magnetic polarity than the first magnet 5, when the lock is to be unlocked. In the above example, since the key 7 is turned clockwise for locking, the indicator magnet 13 is caused to approach the N pole of the first drive magnet 5 and then gradually is moved away therefrom. This is the same whether the key is withdrawn at a location where the key is turned, for example, 180 degrees, or whether the key is withdrawn after it has been turned clockwise by a predetermined angle and then turned counterclockwise by such predetermined angle. Accordingly, if the key 7 is turned clockwise, for example, by 90 degrees when the lock is in a locked position, the S pole of the indicator magnet 13 is drawn to the N pole of the first drive magnet 5 as shown in FIG. 4, and is held by the holding plate 12 in the sate shown in FIG. 4. Thereafter, a further turning operation of the key 7 in an effort to bring the indicator magnet 13 away from the first drive magnet 5 does not make any change of the state shown in FIG. 4. The same is true when the key 7 has been withdrawn from the key way.

As shown in FIG. 4, that side surface of the indicator magnet 13 denoted by q is painted, for example, green and the other side surface denoted by 4 is painted, for example, red. Accordingly, when the green side surface of the indicator magnet 13 within the magnet holding chamber 11 is visually recognized through a viewing window 14 open to one side surface of the key bow of the key 7 as shown in FIG. 3, it is known that the cylinder lock 1 is in a locked position. The same is true when the user removes the key and see it at his/her visiting cite. On the other hand, in order to unlock the cylinder lock 1 in a locked position, the key 7 is inserted into the key way 4 of the cylinder lock 1 and turned counterclockwise. The result is that when the key 7 is turned counterclockwise by about 90 degrees, the first drive magnet 5 if FIG. 4 is switched to the second drive magnet 6. In other words, the N pole of the drive magnet 5 of FIG. 4 is inverted (not shown) to its S pole. As a result, the S pole of the indicator magnet 13 repulses the S pole of the second drive magnet 6 and floats over the holding plate 12. On the other hand, the N pole of the indicator magnet 13 is drawn to the S pole of the second drive magnet 6. That is, the indicator magnet 13 is turned 180 degrees about a rotary axis vertical to the sheet surface of FIG. 4, so that the red-colored side surface denoted by r can be seen through the viewing window 14 (see FIG. 3). In this way, the key 7 can indicate the unlocking state of the cylinder lock 1. The angular position of the indicator magnet 13 showing the unlocking state of the like is stably maintained by the indicator magnet 13 secured to the holding plate 12.

However, the above-mentioned operation of the locking/unlocking state confirming device is the operation originally intended, but such device actually does not operate in that manner. The disclosure of the above Japanese application apparently is based on theoretical considerations without carrying out any substantial experiments. Actually, the indicator magnet 13 does not work at all even if the first and second drive magnets 5 and 6 are mutually switched.

The reason is that, since the holding plate 12 of magnetic properties exists between the drive magnets 5, 6 and the indicator magnet 13, magnetic flux from the drive magnets is cut off by the holding plate 12. Therefore, the indicator magnet 13 does not receive any magnetic repulsive force and magnetic attractive force from the drive magnet, even if the indicator magnet 13 is caused to approach the drive magnet 5 (6). Another reason is that the existence of the holding plate 12 necessitates a substantial distance between the drive magnet 5 (6) and the indicator magnet 13, and a magnetic force is weakened in inverse proportion to the square (second power) of the distance between the drive magnet 5 (6) and the indicator magnet 13.

At any rate, the inventor of the present invention has confirmed through experiments that the invention according to the above-mentioned Japanese Patent Application does not exhibit the originally intended effects.

SUMMARY OF THE INVENTION

It is, therefore, an object of the present invention to provide a locking/unlocking state confirming device which can be operated assuredly and the locking/unlocking state indication of which can be maintained in a stable manner.

To achieve the above object, according to one embodiment of the invention, there is provided a locking/unlocking state confirming device comprising a drive magnet formed of at least a pair of permanent magnets arranged on an outer end face of an outer sleeve of a cylinder lock in symmetrical relation with respect to a key way of an inner sleeve. Each of such permanent magnets is oppositely magnetized in an axial direction of the inner sleeve. A key includes a key bow having non-magnetic properties, and a magnet holding chamber is formed in an area within the key bow which is proximate to a front end face opposite to the cylinder lock and which is generally in alignment with the drive magnet in a radial direction of the cylinder lock when the key is inserted in the key way. An indicator magnet is formed of a permanent magnet acting as a rotor and is magnetized in a direction at a right angle relative to a center axis thereof. The indicator magnet has first and second outer peripheral surfaces with respect to a plane including the center axis and parallel to the magnetizing direction, the first and second peripheral surfaces being of different respective colors. The indicator magnet is turnably received in the magnet holding chamber with the center axis of the indicator magnet extending generally at a right angle relative to a stem of the key. A looking window is open to at least one side surface of the key bow so that the inside of the magnet holding chamber can be seen from outside. A holding plate having magnetic properties is disposed within the key bow at a location rearwardly of the magnet holding chamber.

According to another embodiment of the invention, at least one holding magnet chamber is formed rearwardly of the magnet holding chamber, and a holding magnet having a construction identical with that of the indicator magnet is turnably received in the holding magnet chamber.

According to another embodiment of the invention, each of at least a pair of indicator magnets is formed of a permanent magnet acting as a rotor magnetized in a direction at a right angle relative to a center axis thereof and has a spacer sleeve of non-magnetic properties fitted to an outer side thereof. Each indicator magnet has first and second outer peripheral surfaces with respect to a plane including the center axis and parallel to the magnetizing direction, the first and second peripheral surfaces being of different colors. Each indicator magnet is turnably received in the magnet holding chamber with the center axis of the indicator magnet extending generally at a right angle relative to the stem of the key.

According to another embodiment of the invention, a brake member is guided for movement forwardly and rearwardly within the key bow. The brake member is biased in a forwardly projecting direction. When the key is withdrawn from the key way of the cylinder lock, one end of the brake member projects from a front end face of the key bow, and an opposite end resiliently presses the indicator magnet from rearwardly thereof.

According to a further embodiment of the invention, the locking/unlocking state confirming device may include a metal brake plate disposed proximate to at least one end face of the indicator magnet.

According to a further embodiment of the invention, the holding plate having magnetic properties is disposed adjacent to at least one end face of the indicator magnet.

According to a further embodiment of the invention, respective viewing windows are open to opposite sides of the key bow. Thus, a desired color indicating a locking state can be seen through one viewing window, and the other viewing window showing an undesired color being closed, depending on the direction of turning of the key, either clockwise or counter-clockwise, when the lock is to be locked, and on the magnetizing direction of the drive magnet to which the indicator magnet is caused to approach at that time.

According to another embodiment of the invention, a memory block having magnetic properties is disposed within the key bow at an area that is proximate to a front end face opposite to the cylinder lock and which is generally in alignment with the drive magnet in a radial direction of the cylinder lock when the key is inserted in the key way. A magnet detector is disposed rearwardly of and proximate to the memory block. The magnetizing direction of the drive magnet to which the memory block is caused to approach when the key is turned is detected with reference to a change in state of the magnet detector.

According to a further feature of the invention, a flexible magnetic plate may be secured to a periphery of an end face of the outer sleeve of the cylinder lock. A required part of the magnetic plate is partly magnetized to thereby constitute the drive magnet.

According to another feature of the invention, a mark is provided on a predetermined part of the flexible magnetic plate, so that the magnetizing direction of the drive magnet is changed by bringing the mark into alignment with a specified part of the front end face of the cylinder lock.

BRIEF DESCRIPTION OF THE DRAWINGS

The above and other objects, features and advantages of the present invention and the manner of realizing them will become more apparent, and the invention itself will best be understood from the following description, with reference to the attached drawings showing preferred embodiments of the invention and wherein.

DETAILED DESCRIPTION OF PREFERRED EMBODIMENTS

Figure 1:
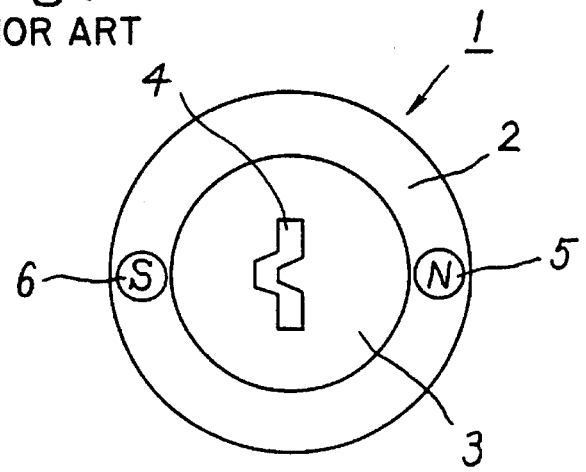
Fig. 1 PRIOR ART
FIG. 1 is a front view of a cylinder lock including a pair of a locking/unlocking state confirming device.
Figure 2:
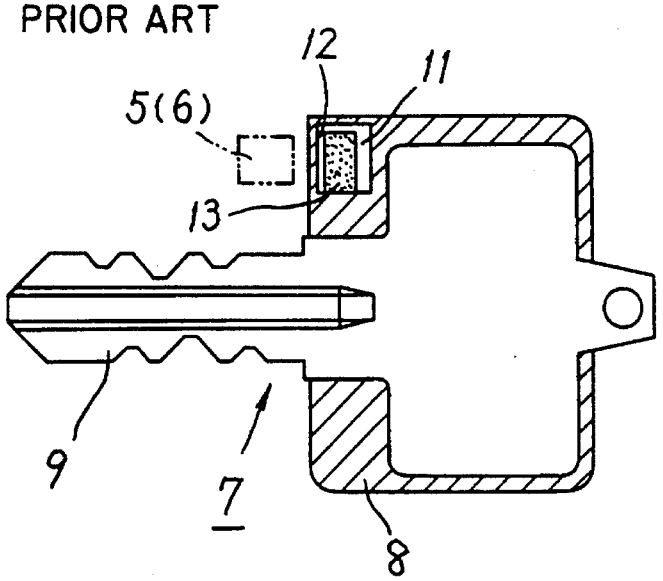
Fig. 2 PRIOR ART
FIG. 2 is a side sectional view of a key including construction of a conventional locking/unlocking state confirming device.
Figure 3:
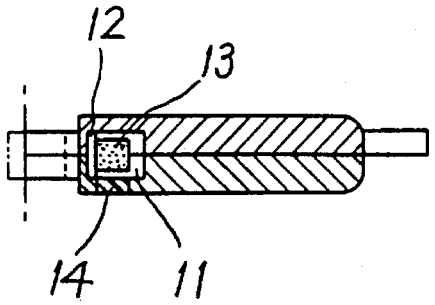
Fig. 3 PRIOR ART
FIG. 3 is a plan view, partly in section, of such key.

A construction of a locking/unlocking state confirming device according to one embodiment of the invention, with reference to FIGS. 1 and 5–7, includes drive magnets 5 and 6 on a side of a cylinder lock 1 and identical with those of a conventional locking/unlocking state confirming device hereinabove described. That is, for example, a concave portion is formed or defined in a predetermined location of an end face of an outer sleeve 2 of the cylinder lock 1, and the drive magnets and 6 each formed of a permanent magnet are embedded in this concave portion. Usually, in order to increase the magnetic force which is to act on an indicator magnet 13, outer surfaces of the drive magnets 5 and 6 are coplanar with the end face of the outer sleeve 2 of the cylinder lock 1. In accordance with necessity, however, the drive magnets 5 and 6 may be embedded deeply in outer sleeve 2 and covered with material that is the same as the material of outer sleeve 2. As in the case of the previously-described conventional locking/unlocking state confirming device, a magnet holding chamber 11 is formed in an area within a key bow 8 that is proximate to a front end face thereof opposite to the cylinder lock 1 and that generally is in alignment with the drive magnet 5 (6) in a radial direction of the cylinder lock 1 when a key 7 is inserted in key way 4. A cylindrical indicator magnet 13 is turnably received in magnet holding chamber 11.

Figure 6:
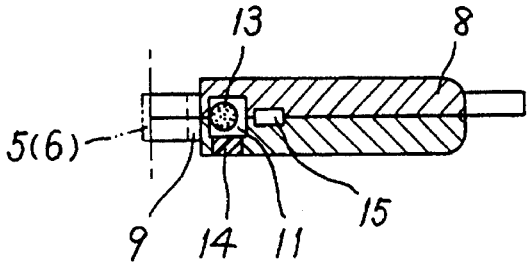
FIG. 6 is a plan view, partly in section, of such key.
Figure 7:
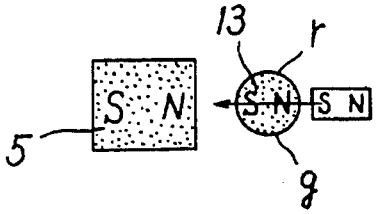
FIG. 7 is an enlarged schematic plan view of main component members thereof.
Figure 8:
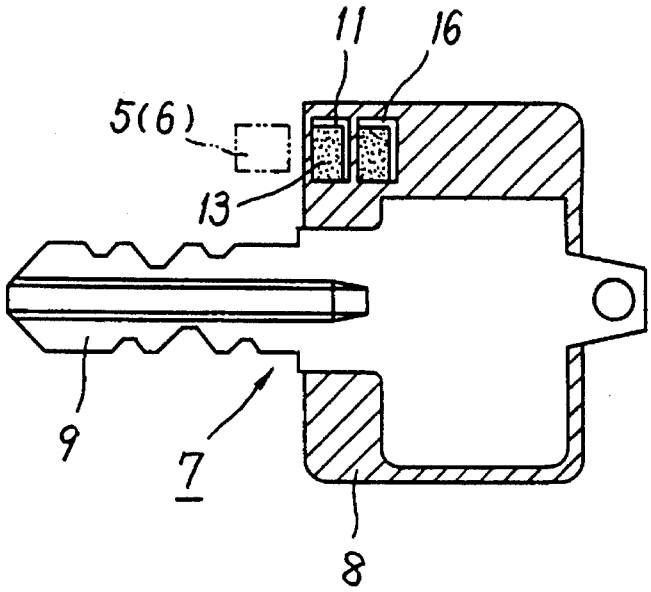
FIG. 8 is a side sectional view of a key according to another embodiment of the invention.
Figure 9:
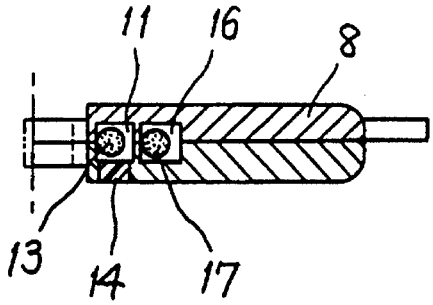
FIG. 9 is a plan view, partly in section, of such key.
Figure 10:
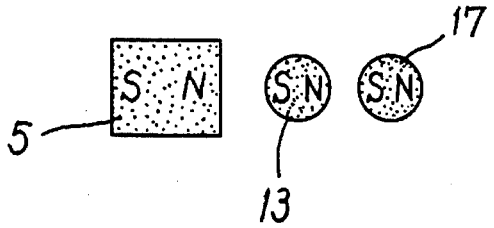
FIG. 10 is an enlarged schematic plan view of component members thereof.
Figure 11:
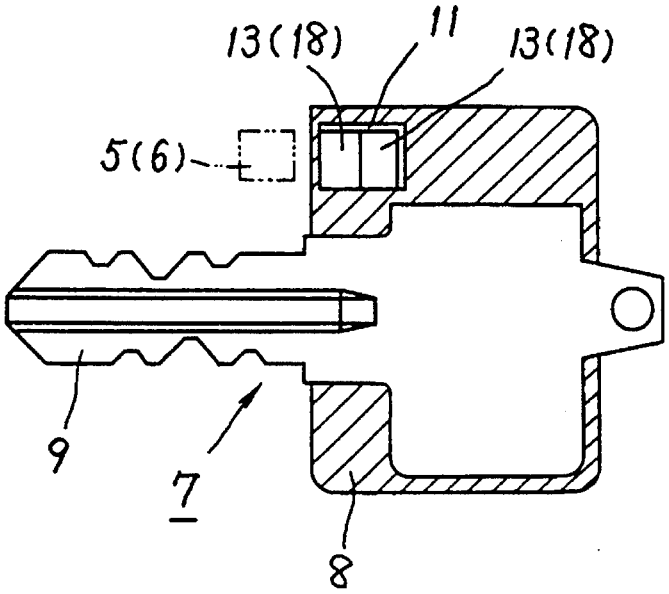
FIG. 11 is a side sectional view of a key according to a further embodiment of the invention.
Figure 12:
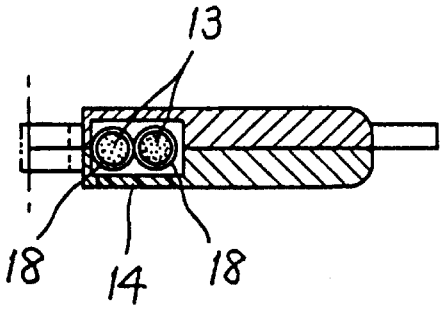
FIG. 12 is a plan view, partly in section, of such key.
Figure 13:
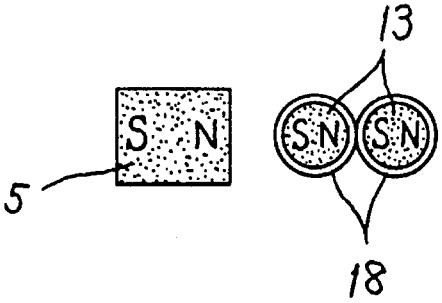
FIG. 13 is an enlarged schematic plan view of main component members thereof.

As shown by an arrow in FIG. 7, the indicator magnet 13 is a permanent magnet acting as a rotor which is magnetized in a direction at a right angle relative to a center axis thereof. The indicator magnet 13 has first and second outer peripheral surfaces with respect to a plane including the center axis and parallel to the magnetizing direction. Such first and second peripheral surfaces are painted in respective different colors, e.g., green g and red r. A holding plate 15 has magnetic properties and is disposed within the key bow 8 at a location rearwardly of the magnet holding chamber 11. In the illustrated example, the holding plate 15 is, for example, of a parallelepiped plate-like member and is embedded in a concave portion or recess formed in a connection area of the key bow 8. In FIG. 6, reference numeral 14 denotes a transparent viewing window as in the conventional locking/unlocking state confirming device hereinbefore described.

In the locking/unlocking state confirming device having the above-mentioned construction, if it is assumed that, as shown in FIG. 7, the indicator magnet 13 is caused to approach the N pole of the first drive magnet 5 when the key is being turned for locking for example, the N pole of the indicator magnet 13, which has been located in a forward position, i.e., position opposite to the cylinder lock, till that time, receives a magnetic repulsive force from the N pole of the drive magnet 5, while the S pole of the indicator magnet 13 receives a magnetic attraction force. As a result, the indicator magnet 13 acting as a rotor is turned about its center axis to bring its S pole toward the first drive magnet S. The N pole of the indicator magnet 13 thereby is moved opposite to the holding plate 15 of magnetic properties. As a result, an S pole and an N pole are induced in the holding plate 15 along a direction forwardly/rearwardly thereof. This relative positional relation between the indicator magnet 13 and the holding plate 15 remains unchanged even after the key has been withdrawn from the key way. Therefore, if the indicator magnet 13 is observed through the viewing window 14, the outer side surface of the indicator magnet painted green, for example, is visually recognized. By this, it can be confirmed that the cylinder lock is in a locked position. At that time, as is apparent from FIG. 7, since there is no magnetic member interposed between the first drive magnet 5 and the indicator magnet 13, the magnetic force of the former is caused to act on the latter without interference. Therefore, the action of the locking/unlocking state confirming device, in other words the turning action of the indicator magnet 13, is assuredly performed.

Figure 4:
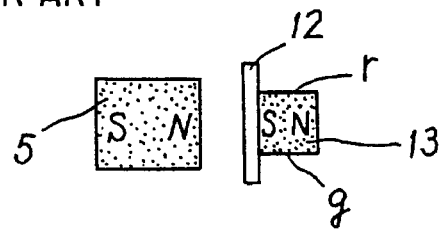
Fig. 4 PRIOR ART
FIG. 4 is an enlarged schematic plan view of main component members of the conventional locking/unlocking state confirming device.
Figure 5:
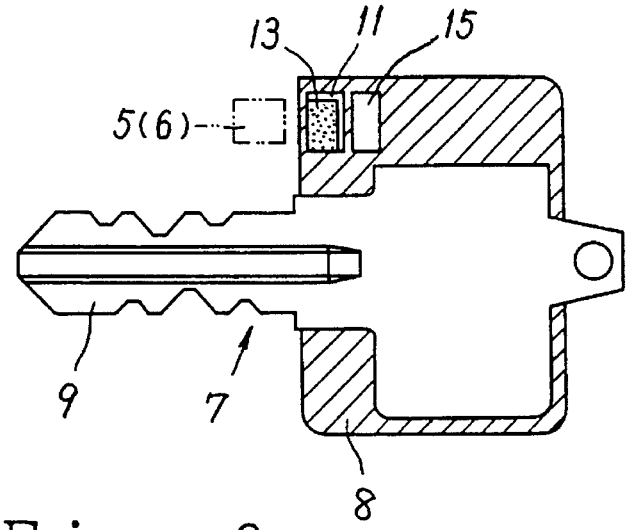
FIG. 5 is a side sectional view of a key including construction of a locking/unlocking state confirming device according to one embodiment of the invention.

The magnetic lock between the indicator magnet 13 and the holding plate 15 can be maintained stably without magnetically attracting the indicator magnet 13 to the holding plate 12 (see FIG. 4) as in the conventional locking/unlocking state confirming device.

Also, when the inner sleeve of the cylinder lock is turned by the key in a direction for unlocking the lock, the S pole of the indicator magnet 13 is brought proximate to the S pole of the second drive magnet 6. Therefore, according to the same principle as previously mentioned, the indicator magnet 13 is turned 180 degrees to cause the red colored outer side surface to face the viewing window 14.

In an embodiment of the invention illustrated in FIGS. 1 and 8–10, a holding magnet chamber 16 is formed behind and proximate to the magnet holding chamber 11 within the key bow 8. A holding magnet 17 having a construction identical with that of the indicator magnet 13, but not painted any color, is turnably received in the holding magnet chamber 16. Since the remaining construction of this embodiment is the same as that of the foregoing embodiment, further description thereof is omitted.

If it is assumed that the indicator magnet 13 is brought proximate to the N pole of the first drive magnet 5 when the key is turned for unlocking, for example, the N pole of the indicator magnet 13 which has been in a forward location, that is in a location opposite to the cylinder lock, till that time receives a magnetic repulsive force from the N pole of the drive magnet 5. On the other hand, the S pole of the indicator magnet 13 receives a magnetic attraction force. As a result, the indicator magnet 13 acting as a rotor is turned about its center axis to bring the S pole toward the first drive magnet 5. At the same time, holding magnet 17 disposed rearwardly of the indicator magnet 13 and having the same construction as the indicator magnet 13 is also turned about the center axis thereof to bring its S pole toward the indicator magnet 13.

This relative positional relationship of magnetic poles between the indicator magnet 13 and the holding magnet 17 is maintained stably without change, even after the key has been withdrawn from the key way. The reason is that the illustrated state, in which the N poles and the S poles of the indicator magnet 13 and the holding magnet 17 are placed opposite to each other, is a state which has the smallest magnetic resistance. If one of the magnets is turned in any direction, the other magnet causes a magnetic force to act on the first magnet so that the first magnet is returned to its original angular position.

Since the remaining functions of this embodiment are the same as those of the previous embodiment, further description thereof is omitted.

In an embodiment of the invention illustrated in FIGS. 1 and 11–13, a relatively large magnet holding chamber 11 is formed within the key bow 8. At least one pair of indicator magnets 13 (one pair in the illustrated example), each having a spacer sleeve 18 fitted thereto, are turnably received in the magnet holding chamber 11. This embodiment is similar to that of FIGS. 5–7 in that each indicator magnet 13 has first and second outer peripheral surfaces (i.e., the spacer sleeve 18 has first and second outer peripheral surfaces) with respect to a plane including the center axis and parallel to the magnetizing direction, such first and second peripheral surfaces being painted in respective different colors.

Magnet holding chamber 11 is of a suitable dimension. Each spacer sleeve 18 functions as a constant space or distance and has non-magnetic properties. Due to this arrangement, a constant distance is maintained between the pair of bare indicator magnets 13 and the pair of indicator magnets 13 never are directly in contact with each other to cause a strong magnetic attraction force therebetween. As a result, one of the indicator magnets never interferes with the turning of the other indicator magnet. The pair of indicator magnets act as if they were received in separate magnet holding chambers. Since the spacer sleeves 18 are securely fitted to outer sides of respective of the indicator magnets 13, the green or red indicator portions of the outer side surfaces are large. As a result, there is the further advantage that the locking state very easily can be confirmed.

Figure 14:
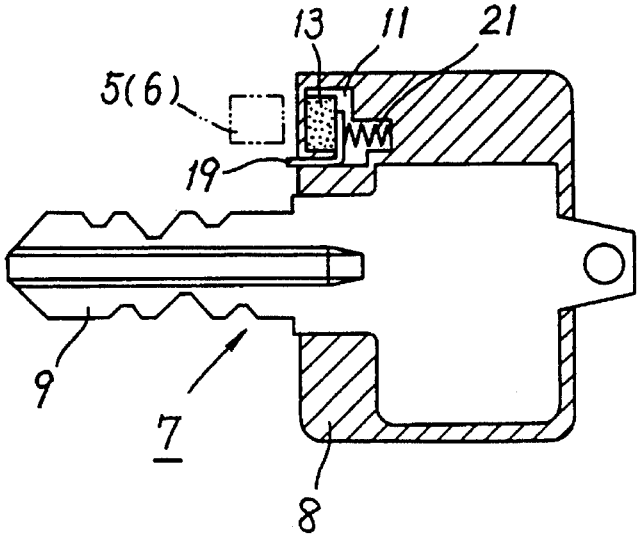
FIG. 14 is a side sectional view of a key according to a still further embodiment of the invention.

In an embodiment of the invention shown in FIG. 14, a plate-like brake member 19, which is L-shaped as viewed from the side, is guided for forward/rearward movement in chamber 11, with one end of brake member 19 projecting from a front end face of the key bow 8. The other end of the brake member 19 is biased by the resilient force of a brake spring 21 to push indicator magnet 13 in a direction toward an inner wall disposed forwardly of the magnet holding chamber 11.

In the normal state where the key 7 already is withdrawn from the cylinder lock and one end of the brake member 19 is allowed to project from the front end face of the key bow 8, the other end of the brake member 19 is caused to resiliently press the indicator magnet 13 toward the front inner wall of the magnet holding chamber 11 by the resilient force of brake spring 21. Thus, an angular indicating position of the indicator magnet 13 is mechanically retained. On the other hand, if the key 7 is inserted into the key way 4 of the cylinder lock, the one end of the brake member 19 is brought into abutment with the front end face of the inner sleeve of the cylinder lock and is pushed into the key bow 8. As a result, the other end of the brake member 19 is moved rearwardly against the resilient force of the brake spring 21 to release the indicator magnet 13. Consequently, the indicator magnet 13 is freed from the brake member 19, and when the key 7 is turned for unlocking, the S pole and the N pole are brought toward the first or second drive magnet 5 or 6 on the side of the cylinder lock in such a manner as to proximate thereto. The angular position of the indicator magnet 13 again will be mechanically retained by the brake member 19 when the key 7 is withdrawn from the key way 4.

Figure 15:
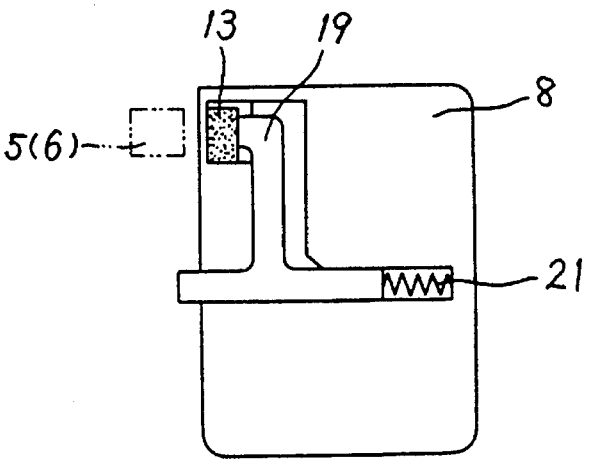
FIG. 15 is a schematic side view of a connection surface of a member constituting a key bow of a key according to yet another embodiment of the invention.
Figure 16:
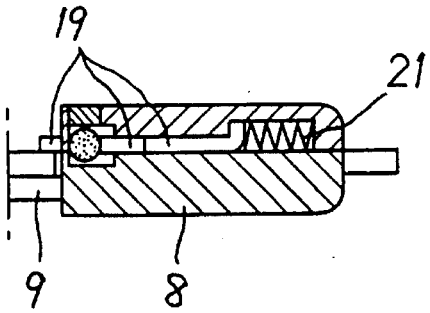
FIG. 16 is a plan view, partly in section, of such key.

In a modification shown in FIGS. 15 and 16, the brake member 19 is formed generally to have a T-shape as a whole. One end of the brake member 19 contacts the inner sleeve of the cylinder lock and is superimposed on a side of a stem 9 of the key. With one end of the brake member 19 superimposed on the stem 9 of the key 7, the brake member 19 is somewhat large. However, there is no danger that, when the key is being carried by its user, one end of the brake member 19 inadvertently will be pushed into the key bow 8 to change (or switch) the indication of the locking/unlocking state.

Figure 17:
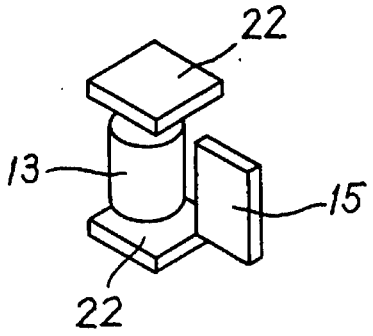
FIG. 17 is a perspective view showing main component members according to a yet further embodiment of the invention.

In the embodiment shown in FIG. 17, metal brake plates 22 are disposed proximate opposite end faces of the indicator magnet 13 of the locking/unlocking state confirming device. Metal brake plates 22 are embedded, for example, in a concave portion formed in the connection area of the key bow 8. When the indicator magnet 13 is turned, an eddy current is induced in metal brake plate 22 in accordance with Lenz's law, and a braking torque is induced to the indicator magnet 13 by interaction between such eddy current and a magnetic flux of the indicator magnet. The larger the angular velocity, the larger the braking torque becomes.

An advantage of causing the braking torque to act on the indicator magnet 13 is that the drive magnet 5 (6) acts as a driving source and a brake for the indicator magnet 13. The drive magnet 5 (6) attracts the indicator magnet 13 after the magnetic poles are inverted by turning the indicator magnet 13 and a braking torque is caused to act on the indicator magnet 13. Of course, this braking torque acts only when the drive magnet 5 (6) is proximate to the indicator magnet. Therefore, if the key is slowly turned for locking/unlocking, braking is effective so that the key will not go beyond the angular position after the indicator magnet 13 has been inverted. However, if the key is rapidly or abruptly turned, since the drive magnet, which causes the braking torque to act on the indicator magnet 13 after the indicator magnet 13 has been turned, is brought away from the indicator magnet 13, the indicator magnet 13 is overly turned due to its inertia. There results the inconvenience that the red or green color, for example, of the outer surface of the indicator magnet 13 is brought to the viewing window position. However, such inconvenience will not occur with the locking/unlocking state confirming device according to this embodiment.

Figure 18:
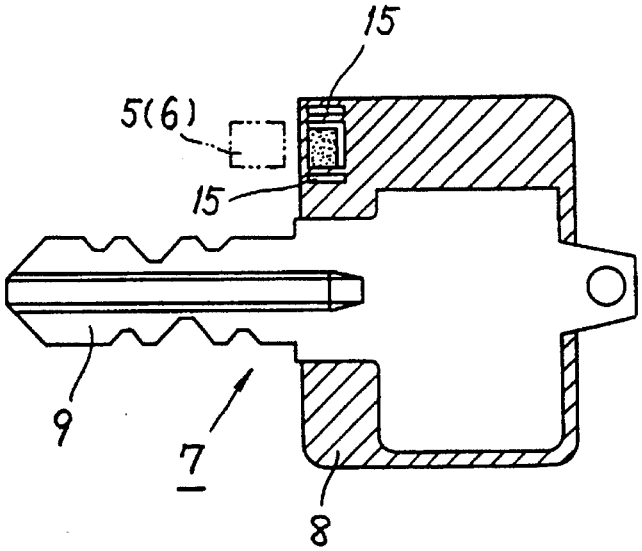
FIG. 18 is a side sectional view of a key according to even a further embodiment of the invention.
Figure 19:
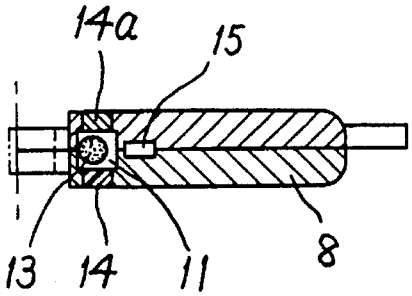
FIG. 19 is a plan view, partly in section, of such key.

In the embodiment shown in FIG. 18, holding plates 15 having magnetic properties are disposed proximate to opposite end faces of the indicator magnet 13 turnably received in the magnet holding chamber 11. Holding plates 15 are secured within the key bow 8 by being embedded in a concave portion formed in the connection area thereof. Plates 15 function as do the brake plates 22 in the embodiment of FIG. 17. After the indicator magnet 13 has been inverted, the holding plates 15 stably hold the angular position of the indicator magnet 13 by means of magnetic engagement (magnetic attraction) between the holding plates 15 and the indicator magnet 13.

Figure 20:
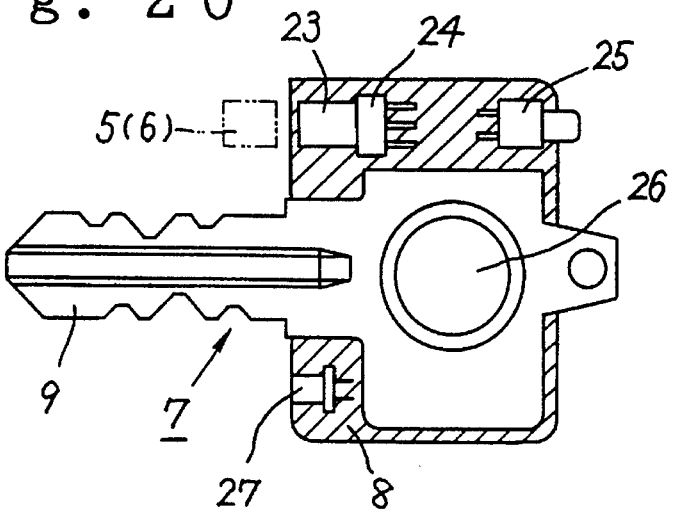
FIG. 20 is a side sectional view of a key according to even another embodiment of the invention.
Figure 21:
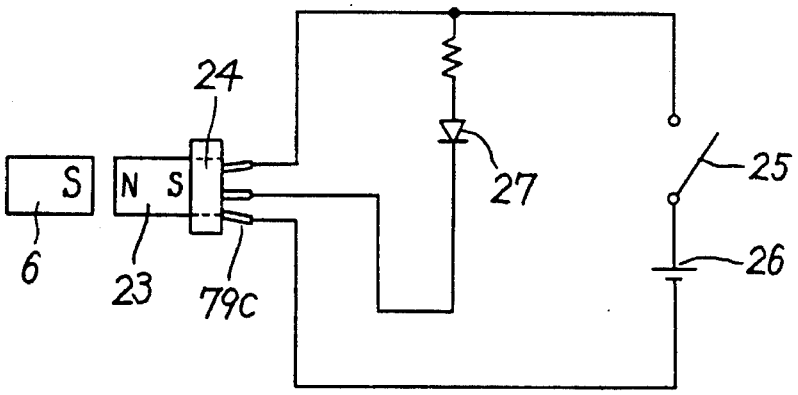
FIG. 21 is a circuit diagram showing connection of various component members of FIG. 20.

In the embodiment shown in FIG. 20, a memory block 23 of semirigid magnetic properties is disposed in that area within the key bow 8 which is proximate to a front end face opposite to the cylinder lock and which is generally in alignment with the drive magnet 5 (6) in a radial direction of the cylinder lock when the key is inserted in the key way 4. Memory block 23 is formed, for example, in a circular cylindrical contour and is secured firmly within the key bow 8 with a center axis thereof generally in parallel with a step of the key. A detector 24 such as a Hall element is disposed proximate to an inner (rear) end face of the memory block 23. A micro-miniature memory switch 25, a battery 26 and a light emitting element 27 such as a light emitting diode are connected in a circuit as shown in FIG. 21. If the Hall element acting as detector 24 is of the type such that an electric current flows when, for example, an S pole is caused to approach the magnetic detection surface of the Hall element when the memory block 23 is brought proximate to the second drive magnet for unlocking the cylinder lock, the memory block 23 is magnetized as shown in FIG. 21 and this magnetism is maintained even after removal from the drive magnet. In such case, since the S pole is brought opposite to the magnetic detection surface of the Hall element, when the user takes out the key at his/her visiting cite, for example, and depresses the switch 25, the light emitting diode 27 emits light to indicate the fact that the cylinder lock is in the unlocked position. It is, of course, not necessary to provide a viewing window for checking the rotary angular position of the indicator magnet. On the other hand, when the cylinder lock has been unlocked, an N pole is brought opposite to the magnetic detection surface of the detector 24. In that event, the light emitting element 27 does not emit light if the switch 25 is depressed. Thus, the type of magnetic pole at the rear end of the memory block is detected by the Hall element detector, and there can be determined the type of magnetic pole of the drive magnet through which the memory block has passed the lat time. In other words, it can be determined whether or not the key has been turned for locking or unlocking.

Needless to say, any of the above locking/unlocking state confirming devices of the invention can be provided on the cylinder lock side with drive magnets of the type shown in FIG. 1.

Figure 22:
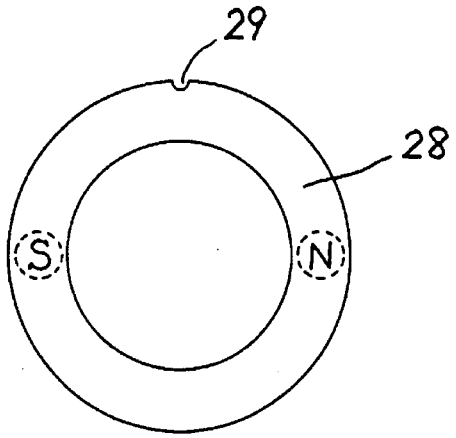
FIG. 22 is a front view of a flexible magnetic plate employable according to another embodiment of the invention.

The embodiment of FIG. 22 includes an annular flexible magnetic plate 28. In a preferred example, flexible magnetic plate 28 may be a rubber magnet. For example, areas of the flexible magnetic plate 28 which are illustrated as being encircled with dotted lines are partly magnetized. Flexible magnetic plate 28 is adhered to the outer sleeve 2 of the cylinder lock. Such adhesion preferably is provided by an adhesive agent or a pressure sensitive adhesive double coated tape. The magnetized portions act as the drive magnets. Although magnetic plate 28 has an annular contour in the illustrated example, it may have a horseshoe-shaped contour. When the drive magnet is formed of a flexible magnetic plate that is adhered later, there can be obtained the advantage in that the locking/unlocking state confirming device can be incorporated into an existing cylinder lock.

A mark 29 is formed by cutting or notching a part of the outer periphery of the flexible magnetic plate 28. However, the mark 29 may be simply painted. Mark 29 is formed at a predetermined location of the flexible magnetic plate. With this feature, by bringing mark 29 into alignment with an angular position, for example, of twelve o'clock or six o'clock (in the sense of a clock face) of the outer sleeve of the cylinder lock, an indicator magnet of a desired color such as, for example, green, can be seen through the viewing window without switching the opening thereof.

Although the invention has been illustrated and described with respect to exemplary embodiments thereof, it will be understood by those skilled in the art that the foregoing and various other changes, omissions and additions may be made therein and thereto without departing from the spirit and scope of the present invention. Therefore, the present invention should not be understood as being limited to the specific embodiments set forth above but to include all possible variations which can be embodied within a scope encompassed by features set forth in the appended claims and equivalents thereof.

What is claimed is:

1. A locking/unlocking state confirming device comprising:

a drive magnet formed of at least a pair of permanent magnets arranged adjacent an outer end face of an outer sleeve of a cylinder lock in symmetrical relation with respect to a key way of an inner sleeve, said pair of permanent magnets being mutually oppositely magnetized in an axial direction of said inner sleeve;

a key provided with a key bow of non-magnetic properties;

a magnet holding chamber formed in an area within said key bow that is proximate to a front end face opposite to said cylinder lock and which is generally in alignment with said drive magnet in a radial direction of said cylinder lock when said key is inserted in said key way;

an indicator magnet formed of a permanent magnet acting as a rotor magnetized in a direction at a right angle relative to a center axis thereof, said indicator magnet having first and second outer peripheral surfaces with respect to a plane including said center axis and parallel to the magnetizing direction, said first and second peripheral surfaces having respective different indicia with respect to each other, said indicator magnet being turnably received in said magnet holding chamber with said center axis of said indicator magnet extending generally perpendicular relative to a stem of said key;

a viewing window open to at least one side surface of said key bow so that the inside of said magnet holding chamber can be seen from outside; and a brake member movably guided for movement forwardly and rearwardly within said key bow, said brake member being biased in a forwardly projecting direction such that when said key is withdrawn from said key way of said cylinder lock one end of said brake member projects from a front end face of said key bow, said brake member having another end resiliently pressing said indicator magnet from a rear side thereof, thereby regulating rotation of said indicator magnet about said center axis as a function of positions of said key relative to said permanent magnets.

2. A device as claimed in claim 1, further comprising a metal brake plate disposed proximate to at least one end face of said indicator magnet.

3. A device as claimed in claim 1, further comprising a flexible magnetic plate secured to a periphery of said outer sleeve of said cylinder lock, portions of said magnetic plate being partly magnetized to thereby constitute said drive magnet.

4. A device as claimed in claim 3, wherein a predetermined part of said flexible magnetic plate has a mark, whereby the magnetizing direction of said drive magnet is changed by bringing said mark into alignment with a specified part of the front end face of said cylinder lock.

* * * * *